United States Patent [19]

Itagaki

[11] Patent Number: 4,531,331

[45] Date of Patent: Jul. 30, 1985

[54] DISPLAY APPARATUS

[75] Inventor: Takafumi Itagaki, Urayasu, Japan

[73] Assignee: Tamatoshi Industries Ltd., Tokyo, Japan

[21] Appl. No.: 498,784

[22] Filed: May 27, 1983

[51] Int. Cl.[3] ..... E04B 1/00; G09F 7/18

[52] U.S. Cl. ..... 52/38; 52/288; 52/105; 52/630; 211/189; 248/222.2

[58] Field of Search ..... 52/105, 630, 36, 38; 248/222.2, 220.2, 220.3; 211/189

[56] References Cited

U.S. PATENT DOCUMENTS

| | | | |
|---|---|---|---|
| 1,967,620 | 7/1934 | Kahn | 52/630 |
| 2,753,018 | 7/1956 | Curell | 52/630 |
| 2,806,561 | 9/1957 | Spangler | 52/630 |
| 2,952,341 | 9/1960 | Weiler | 52/630 |
| 3,128,851 | 4/1964 | Deridder et al. | 52/630 |
| 3,184,233 | 5/1965 | Cook | 52/630 |
| 4,159,601 | 7/1979 | Ebert et al. | 52/36 |
| 4,323,163 | 4/1982 | Johns | 52/588 |
| 4,420,087 | 12/1983 | Johns | 52/588 |
| 4,450,970 | 5/1984 | Shepherd | 52/36 |

FOREIGN PATENT DOCUMENTS

| | | | |
|---|---|---|---|
| 1231024 | 5/1971 | United Kingdom | 52/105 |

*Primary Examiner*—James L. Ridgill, Jr.

*Attorney, Agent, or Firm*—Cushman, Darby & Cushman

[57] ABSTRACT

An apparatus for displaying articles comprising: modular panels adapted to be joined together and fastened to a support wall, each panel having a back wall, a plurality of ribs extending outwardly from the back wall at separated intervals, a plurality of flanges each extending from the other end of the rib to form surfaces parallel to the back wall and coplanar with the surfaces of the other flanges and, to form channels between the back wall and adjacent flanges, a lower extension of the back wall, and an upper extension of the back wall extending beyond the uppermost flange, having a furrow for receiving the lower extension of another panel and having an indentation for indicating positions of bores for driving fasteners through the upper extension to fasten the panel to said wall. The lowermost flange of the other panel covers the fasteners when the lower extension is received by the furrow. The display apparatus also includes at least one hook element for receiving articles to be displayed, with means for slidably supporting said hook element on one of said flanges.

10 Claims, 6 Drawing Figures

DISPLAY APPARATUS

BACKGROUND OF THE INVENTION

This invention relates to a display apparatus comprising at least one panel module with a hook element or elements demountably attached onto the panel surface for retaining articles for display, and such a modular panel for display.

The display apparatus in question is known in prior art. For instance, Japanese Utility Model Pre-publications Nos. 58-14763 and 58-14764 both disclose a display apparatus which comprises a modular panel and a hook element or elements adapted to be engaged on the display panel. The latter is formed with a plurality of channel projections for engagement of the elements on the panel. The channel projections extend horizontally in rows spaced a determined distance from each other, and have a cross-section shaped like a T with its flange portion being spaced by its vertical member from, and lying in parallel with, the web portion of the panel, so that when the panel is in use in an standing position, each T-shaped crosssectional channel projection defines an upward and a downward facing trough-like channel with both sides of the T's vertical member wall and the underside of the T's flange portion relative to the surface of the panel web. The upward facing channels are opposite the downwards facing ones of the contiguous channel projections. A slot-like opening is defined by each pair of the contiguous channel projections between the opposite end faces of the T's flange portions of the contiguous channel projections for providing access to the channels so formed and the web surface of the panel. The hook element adapted to be mounted on the panel has a mount base portion having a greater length than the width of the slotlike opening so that the mount base portion can be oriented and inserted through the slot-like opening for engagement in the upward and downward facing channels of the contiguous channel projections. The hook element has a hook portion extending from the mount base portion and serving to suspend an article for display. Alternatively, the hook element may be attached to a separate engagement piece which is formed to be fitted on the flange portion of the channel projection. The hook element has a hook freely suspended from the engagement piece.

When the modular panels according to the prior art are mounted on a structural support wall side by side contiguously in the vertical direction, each modular panel does not present any surface area except for a restricted area of the web surface accessible through the slot-like openings between the channel projections, which deteriorates efficiency of the positioning and rivetting operation, or makes the same operation difficult. If a modular panel is incorrectly positioned in the vertical position, inconveniencing the mounting of succeeding modules in correct positions, this is likely to eventually generate a gap or an overlapping between the contiguous panels, devastating construction of a display system. Incorrect positioning of the modular panels may often deprive the display system of smooth continuity of the horizontal channels over any laterally contiguous panels, restricting efficiency and available positions for placing hooks on the panel.

Even if modular panels could be rivetted in correct positions, the heads of rivets thus planted in the restricted area between the channel projections are exposed to the view of observers of articles displayed in the display apparatus, impairing appearance of the resultant system which is critically important in the field of display.

The hook member in the prior art is rather rugged and large and complicated in the arrangement for bearing a good load of suspended articles, which tends to make the display apparatus expensive in the prior art. For instance, in the latter of the aforementioned prior art references, a lock means is provided in the hook member for locking the hook member on the panel, but it obviously complicates and make expensive the display apparatus.

SUMMARY OF THE INVENTION

One of the objects of the invention is to provide a display apparatus where modular panels can be easily positioned and mounted by means of rivets on a structural support wall in correct positions relative to each other.

Another object of the invention is to provide a display apparatus where modular panels can be easily joined to each other at the joining portion, facilitating correct positioning of the contiguous modular panels.

Another object of the invention is to provide a display apparatus where rivets attaching the panels on a structural support wall and the joining seams of the panels are concealed from the observers, thus maintaining a good appearance of the surfaces of the modular panels.

A further object of the invention is to provide a display apparatus where hook elements for retaining articles for display are simplified in arrangement and reliably support a good load of displayed articles.

A still further object of the invention is to provide a display apparatus where hook elements are easily positioned and engaged in any desired position on the panels for easy disengagement and displacement.

There is provided according to one aspect of the invention a display apparatus comprising in combination at least two modular panels adapted to be mounted on a structural support wall in contiguity to each other in vertical and/or horizontal directions and having means located on the front surface to cooperate with at least one hook element for retaining an article to be displayed in place and to provide a surface background against which said article thereby retained to be displayed is viewed by observers, one of said modular panels having means in the upper margin for concealing the lower margin of the other modular panel as mounted in contiguity and indicating a position to fasten said one modular panel to said structural support wall, and means in the lower margin for concealing said concealing and indicating means from the view of observers.

There is also provided according to the further aspect of the invention a display apparatus comprising in combination at least two modular panels adapted to be mounted on a structural support wall in contiguity to each other in vertical and/or horizontal directions and at least one hook element adapted to be mounted on the modular panels in place for retaining an article to be displayed against a background provided by the surface of the modular panels, said modular panels having a plurality of channel projections on the front surface for engaging said hook element therein, said channel projections defining a plurality of flanges horizontally extending and spaced in parallel from each other and from said front surface and thus each forming a pair of channels relative to said front surface and an elongated slot-like opening with the contiguous channel projections to connect to said channels, a marginal extension in the upper end portion located remote a determined distant from the uppermost one of said flanges and having an engagement relative to the surface of said structural support wall for engaging the lower end of the other modular panel, and a lower marginal end portion contacted below the lower end of the lowermost one of said channel projections whereby the heads of fasteners fixed in one of said modular panels for fastening the latter on said structural support wall are covered by the lowermost one of said flanges.

BRIEF DESCRIPTION OF THE DRAWINGS

This invention is best understood by reference to the accompanying drawings, of which.

DESCRIPTION OF THE PREFERRED EMBODIMENTS

Figure 1:
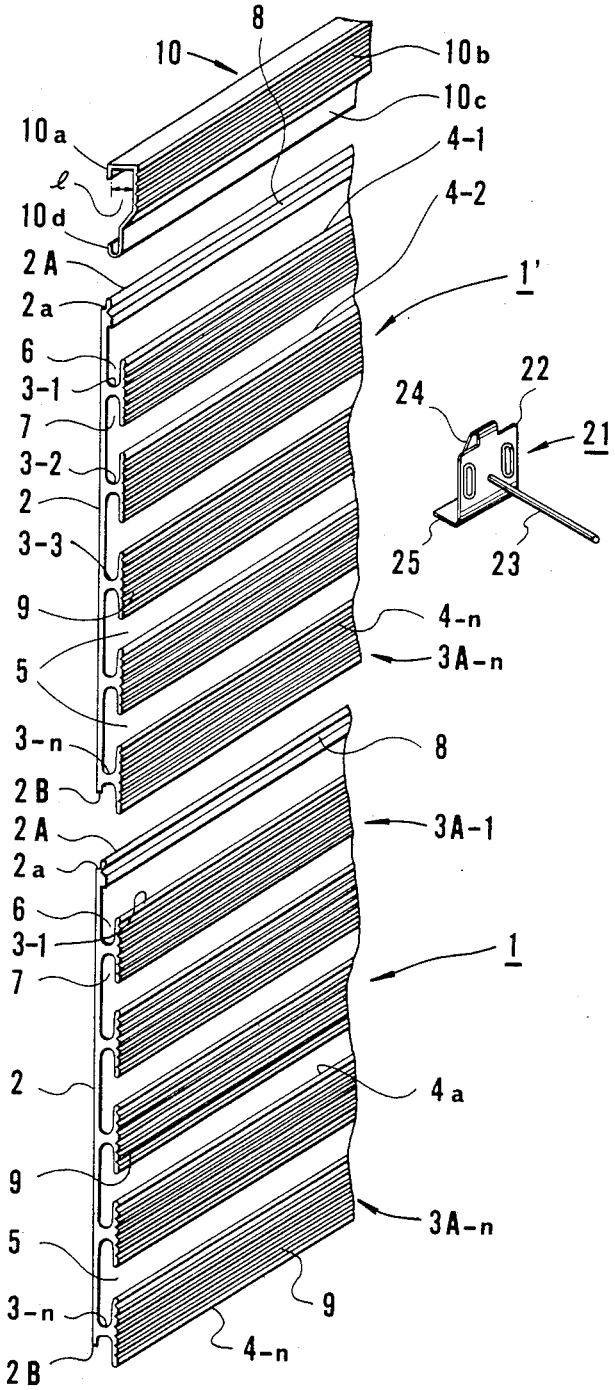
FIG. 1 is a perspective view of one embodiment of the display apparatus according to the invention.

FIG. 1 shows a display apparatus according to the invention which comprises at least two modular panels 2 and a desired number of hook elements. Each modular panel is one-piece molded from light metal material such as aluminum, or rigid plastic material, with a plurality of T-shaped channel projections 3A-1 to 3A-n for engagement of the elements on the panel. The channel projections are each constituted by a horizontally continuous rib 3-1 spaced equidistant from another 3-2 in the vertical direction, and a flange portion 4-1 joined at the central rearside portion to the end face of the rib and lying in parallel with the panel surface. The topsides of the flange portions are thus coplanar with each other and spaced equidistant from each other in the vertical direction. It should be thus understood that upward and downward facing trough-like channels 6 and 7 are defined by each contiguous pair of the flange portions 4-1 to 4-n along the elongated opposite sides of the rib portions 3-1 to 3-n relative to the web surface of the panel. Elongated slot-like openings 5 are formed between each contiguous pair of the flange portions, communicating to the upward and the downward facing channels. Preferably, the vertical width of the elongated slot-like openings should be as small as possible, or less than 2/5 of the width of the flange portions 4-1 to 4-n, insofar as a hook element 24 hereafter described can be detachably engaged in the channels 6 and 7. This facilitates the coplanar topsides of the flanges presenting an ornamentally favorable, continuous surface appearance of the panel against which an article engaged on the hook element for display is to be observed. To enhance the ornamental effect, the topsides of the flange portions may be formed with horizontal linear indentations 9 spaced at a small distance for the ornamental purposes. Any other types of ornamental means, such as patterns with curves, fluorescent and reflective material, or mirrors, are applied on a relatively wide area of the surfaces of the flange portions.

The modular panel 2 has a marginal extension 2A in the upper end portion in parallel with, and spaced a determined distant from, the uppermost flange portion 4-1. The marginal extension is thicker than the web panel and has a furrow **2*a* depressed along the end face of the panel in an equivalent distance to the thickness of the web panel. The furrow-like depression 2*a* is to define an elongated pocket or groove G1 relative to the surface 11 of a structural support wall on which the modular panel has been mounted in place, the elongated pocket G1 being directed to connecting to another modular panel. On the front surface of the upper marginal portion 2A there is provided a linear indentation 8 for indicating positions of bores for rivetting. The lower end portion 2B of the modular panel is located adjacent to the rib 3-n of the lowermost flange portion 4-n**, leaving the edge of the latter projecting from the web panel.

Figure 2:
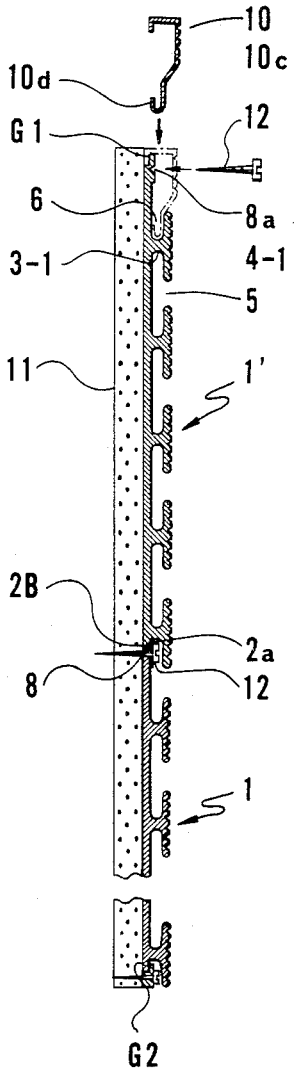
FIG. 2 is a sectional view taken along line 2—2 in FIG. 1.

The display apparatus according to the invention further comprises an upper and a lower cover member 10 and 20 for concealing the upper end portion of the top modular panel or panels and supporting the lower end portion of the bottom modular panel or panels in an array of the mudular panels, respectively. Specifically, the top cover member 10, as shown in FIG. 1 and 2, has the top end portion curved rearwardly into the form of a downward facing channel or engagement section **10*a* with a depending edge adapted to be fitted in the furrow 2A in the upper marginal end portion of the modular panel. The top end portion also extends forwardly to form a front depending portion 10*b* stepped to narrow a distance of elongated opening 1 and further extending as extension 10*c* which in turn terminates as a front rounded folding edge 10*d* being adapted to snugly rest in the upward facing channel 6** of the modular panel. The dimensions of all the sections of the upper cover member are selected such that the latter can be fixed on the top panel module of the system.

The lower cover member has a stepped wall portion with a furrow depressed to an equivalent distance to the thickness of the web panel and a linear depression for indicating the position for rivetting the member on the surface of a structural support wall. Thus, the furrow-like depression defines an elongated pocket or groove G2 relative to the surface of a structural support wall, the elongated pocket G2 being directed to receive the lower margin 2B of the lowermost module.

Figure 3:
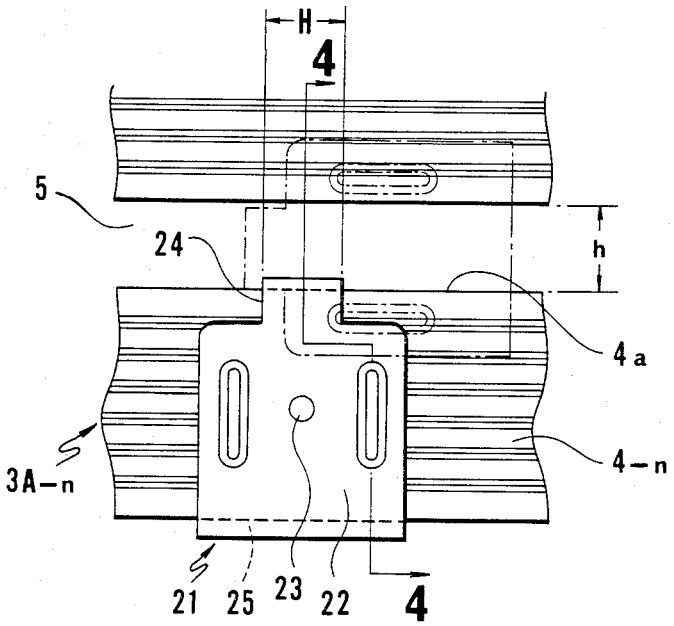
FIG. 3 is an enlarged plane view of a hook element on a modular panel in the embodiment of FIG. 1.
Figure 4:
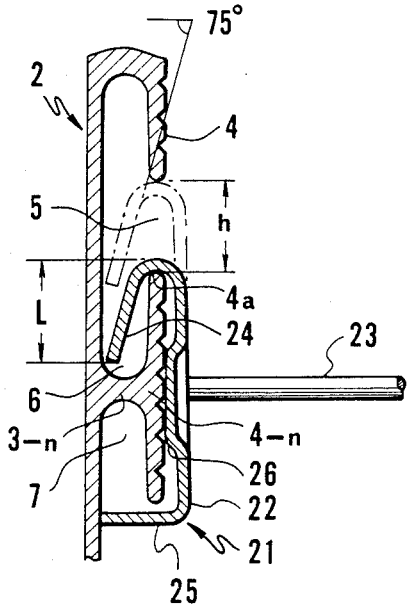
FIG. 4 is a sectional view taken along line 4—4 in FIG. 3.

The hook element 21, as most clearly shown in FIGS. 3 and 4, comprises in general a mount base portion 22 and a hook shaft 23 projecting from the central front surface. The mount base portion 22 is formed with an upper end portion 24 roundly bent in the direction of the rearside thereof to form a depending portion therein, and a lower end portion 25 bent rearwardly to form an upstanding flange. The base portion may be provided with a pair of rearward projections 26 therein as shown in FIG. 4. FIGS. 3 and 4 show that the dimension of the hook is such that a horizontal width "H" of the upper end portion 24 is suitably smaller than a distance "h" of the slot-like openings 5 as measured vertically in the front surface of the modular panel, and that a vertical length "L" of the depending portion of the bent end 24 is suitably greater than the mentioned distance "h". The depending portion of the upper bent end of the mount base is inclined at an appropriate angle, or in this preferred embodiment, 15 degrees relative to the front surface of the mount base, as shown in FIG. 4, for the purposes hereafter described.

To construct a panel system of modules 1 and 1' on the surface of a structural support wall, rivet bores 8*a* are drilled at a determined spacing along the linear indentations 8 of the modular panels 1 and 1'. The first or lower module 1 is placed and secured in place on the surface of a support wall by means of rivets 12 which fasten the top marginal portion of the module on the support wall surface. Inserted into the elongated pocket G1 defined by the module 1 thus fastened relative to the support wall surface, is the bottom marginal portion 2B of the second or upper module 1' which is to be secured in contiguity with the lower one so that the lowest flange 4-n of the upper module comes to cover or conceal the rivetted upper marginal portion of the lower module at which the upper one is joining. This manner of joint presents a favorable appearance of continuity without the ornamental effect of the surfaces of the individual panel modules being impaired by the heads of rivets and the joining seam between the two modular panels. In other words, the view of observers is not obstructed by the rivet heads and seams, but the observers can observe an article on the hook element (details of which will be described hereafter) against a wide, visually non-obstructive background of the modular panel surface. The joining manner serves to position the second module in place relative to the first one. Thus, with the lower margin of the upper module being received, the latter is placed against any undesired shift which facilitates rivetting operation of the upper module on the support wall surface in a similar manner as the lower module. In order to conseal the upper marginal portion of the upper module and the heads of rivets therein which will impair appearance of the apparatus if they remain unconcealed from the observers' view, the cover member 10 is mounted along the upper margin of the module, with the extension 10*c* and folding edge 10*d* snugly received in the upward facing channel 6 and the engagement section 10*a* engaged in the furrow-like indentation 2*a*. The lower marginal portion of the lowermost module in the apparatus may or may not be unconcealed by the aforementioned cover member. Alternatively, any other cover means than the aforementioned member may be mounted thereon.

The hook element 21 is mounted on the surface of the modular panel with the upper bent end portion 24 resting over the upper edge 4*a* of the flange 4 of the panel module. To mount the hook element 21 thereon in place, specifically, the hook mount base is oriented to lay the rearside depending portion of the upper bent end portion 24 in the horizontal direction in parallel with the slotlike opening, so that the depending portion can pass through the slot-like opening since the former has a smaller width "H" that the opening distance "h" of the slot in the panel. After the depending portion of the bent end of the hook mount base has passed through the slot-like opening in the modular panel, the hook element is then turned 90 degrees to a set position with the upper bent end exactly resting on the upper edge 4*a* of the flange 4. Once the hook element is thus set in place, the length "L" of the depending portion of the upper bent end being greater than the opening distance "h" of the slot in the modular panel, prevents the hook element from being pushed upwards by action of forces inadvertently exerted often when an article is placed on the hook shaft for display, thus reducing probability of dislodgement of the hook element from the panel surface. In this set position, the hook base is dimensioned so that the end face of the flange 25 of the hook base rests on the front surface of web panel, and the rearward projections in the mount base abut on the front surface of the flange 4 of the modular panel. This helps stabilizing the hook element on the panel surface.

The hook element 21 can be disengaged from the panel surface by raising the flange portion 25 away from the web panel surface pivotting the mount base with the upper bent end portion resting on the upper edge of the flange of the modular panel surface, eventually for the flange portion to be brought out of the slot-like opening in the modular panel, and then turning the mount base back 90 degrees so that the upper bent end portion lies horizontally in parallel with the slot-like opening and can be brought out of the slot-like opening. The inclination of the depending portion of the upper bent portion permits the mount base to be pivotted on the upper edge of the flange portion of the panel module. Obviously, the hook element can be caused to slide to a desired position to mount along the slot-like opening with the upper bent end portion lying in parallel with the slot-like opening of the modular panel.

Figure 5:
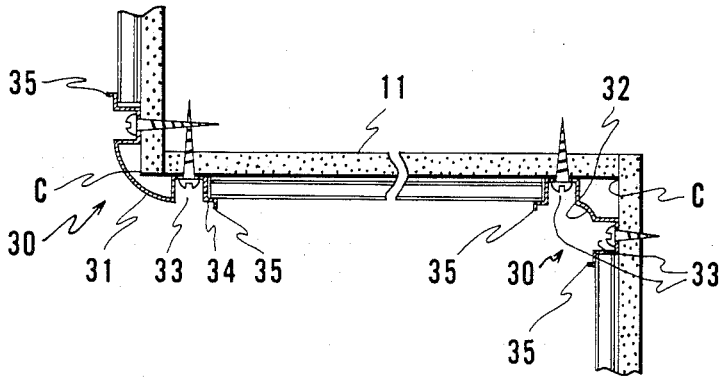
FIG. 5 is a sectional view of a second embodiment of the display apparatus according to the invention.

The display apparatus according to the invention may further have a corner wall structure 30 of concave or convex shape as shown in FIG. 5 for covering or concealing a recessed or a projecting angle formed by two structural support walls on which the modular panels are mounted. The corner wall structure comprises a rounded sub-wall 31 or 32, convex or concave, at least a pair of grooves 33 in the opposed lateral ends with the rearsides being adapted to contact the structural support walls, and at least a pair of retention shoulders 34 extending from the opposed extreme edges of the grooves to receive the lateral ends of the modular panels snugly therein. Each of the retension shoulders has a ridge 35 extending in the direction of the thickness of the modular panel. A convex or concave surface wall member P is fitted between the extreme ridges to join coplanarly the two side-by-side modular panels. The corner wall structure may be fixed by means of rivets planted in the grooves 33 and the structural support wall. The rivets are concealing by the wall member thereafter fitted on the wall structure.

Figure 6:
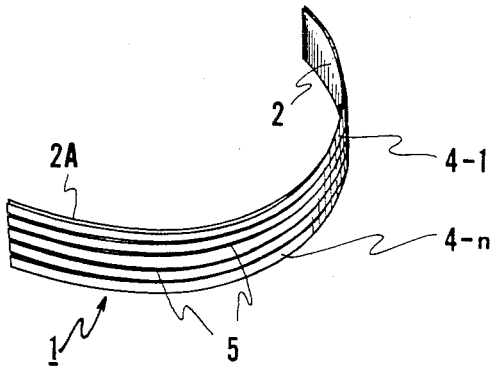
FIG. 6 is a perspective view of a third embodiment of the display apparatus according to the invention.

In the foregoing embodiment, the modular panel is of a rectilinear section, but may be modified to a curved section shown in FIG. 6 which depicts a modification having a convex front surface. It is obvious that a further modified modular panel may have a concave front surface. Curvature in the modifications can be selected in accordance with a desired configuration of the display system. Various modifications of concave and/or convex shapes with various curvatures may be combined to provide desired configurations of display apparatuses, such as sectorial, cylindrical, sinuous or like configurations.

The member referred to hereabove as "a structural support wall" may be a surface of interior building walls, pillars, etc. including equipment, furniture, etc., or any kind of substructure on which a wall member can be mounted to form a wall.

What is claimed is:

1. An apparatus for displaying articles comprising:

first and second modular panels joined together and fastened to a support wall, each panel having (1) a back wall, (2) a plurality of ribs extending outwardly from said back wall at separated intervals, (3) a plurality of flanges each extending from the other end of each of said ribs to form surfaces parallel to said back wall and coplanar with the surfaces of the other flanges, and to form channels between said back wall and adjacent flanges, (4) a lower extension of said back wall (5) an upper extension of said back wall extending beyond the uppermost flange, having a furrow for receiving the lower extension of another panel and having an indentation for indicating positions of bores for driving a fastening means through said upper extension to fasten said panel to said wall, the lowermost flange of said another panel covering said fastening means when the lower extension thereof is received by said furrow and, at least one hook element for receiving articles to be displayed, means slidably supporting said hook element on one of said flanges.

2. The display apparatus according to claim 1 wherein said plurality of flanges have a plurality of linear indentations on said surfaces.

3. The display apparatus of claim 1 wherein each of said hook elements has a shaft extending outwardly therefrom.

4. The display apparatus according to claim 1 wherein said modular panels are convex in shape.

5. The display apparatus according to claim 1 further including a corner wall structure for concealing a corner formed by two structural walls on which said modular panels are mounted.

6. The display apparatus of claim 1 wherein said means for slidably supporting said hook element is comprised of an upper portion received in said channel and a base portion engaging said flange.

7. The display apparatus of claim 6 wherein a lower portion is received in another of said channels.

8. The display apparatus according to claim 1 wherein the uppermost of said ribs and said flanges form an open ended trough.

9. The display apparatus according to claim 8 wherein a cover member having a top surface and, first and second portions depending therefrom; said first depending portion received in said furrow of said upper extension, and said second depending portion received in said trough.

10. The display apparatus according to claim 9 wherein a rounded bead-like edge terminates said second depending portion, and said edge is snugly received in said trough.

* * * * *